United States Patent [19]

Nambudiry

[11] Patent Number: 4,863,628

[45] Date of Patent: Sep. 5, 1989

[54] DETERGENT COMPOSITIONS CONTAINING FATTY ACID SOAP AND MONOESTERS OF DICARBOXYLIC ACIDS

[75] Inventor: Mayara E. Nambudiry, Bombay, India

[73] Assignee: Lever Brothers Company, New York, N.Y.

[21] Appl. No.: 310,479

[22] Filed: Feb. 13, 1989

Related U.S. Application Data

[63] Continuation of Ser. No. 914,022, Oct. 1, 1986, abandoned.

[30] Foreign Application Priority Data

Oct. 8, 1985 [GB] United Kingdom ..... 8524727

[51] Int. Cl.[4] ..... C11D 9/26

[52] U.S. Cl. ..... 252/132; 252/108; 252/134; 252/174.19; 252/DIG. 16

[58] Field of Search ..... 252/108, 132, 134, DIG. 16, 252/174.19

[56] References Cited

U.S. PATENT DOCUMENTS

| | | | |
|---|---|---|---|
| 2,089,305 | 8/1937 | Stickdorn . | |
| 2,972,348 | 5/1957 | Aylesworth . | |
| 3,607,672 | 9/1971 | Kidwell et al. | 252/132 |
| 3,703,481 | 11/1972 | Barker et al. | 252/546 |
| 3,736,339 | 5/1973 | Lamberti et al. . | |
| 4,014,807 | 3/1977 | Werner et al. | 252/132 |
| 4,092,259 | 5/1978 | Prince . | |
| 4,130,640 | 12/1978 | Chazan et al. | 424/80 |
| 4,179,392 | 12/1979 | Heida et al. | 252/108 |
| 4,714,565 | 12/1987 | Wevers et al. | 252/174.19 |

FOREIGN PATENT DOCUMENTS

| | | |
|---|---|---|
| 582065 | 8/1959 | Canada . |
| 953176 | 8/1974 | Canada . |
| 2533101 | 2/1977 | Fed. Rep. of Germany . |
| 1384834 | 11/1964 | France . |
| 15494 | 1/1984 | Japan . |
| 956250 | 4/1964 | United Kingdom . |
| 1314604 | 4/1973 | United Kingdom . |
| 1398772 | 6/1975 | United Kingdom . |
| 1438066 | 6/1976 | United Kingdom . |
| 1444874 | 8/1976 | United Kingdom . |
| 1504927 | 3/1978 | United Kingdom . |
| 2068997 | 8/1981 | United Kingdom . |
| 2075044 | 11/1981 | United Kingdom . |

OTHER PUBLICATIONS

Chemical Abstract 78:99505p (1973).
Chemical Abstract 82:45630q (1975).
Chemical Abstract 87:54912p (1977).

*Primary Examiner*—Prince E. Willis
*Attorney, Agent, or Firm*—Gerard J. McGowan, Jr.

[57] ABSTRACT

A soap based detergent composition contains soluble salts of (C8 to C22) mono-carboxylic acids and water soluble salts of monoesters of general formula $ROOC(CH_2)_nCOOM$ wherein R is a linear or a branched alkyl or alkenyl group containing 4 to 12 carbon atoms, n is 2, 3 or 4 and M is a cation providing water soluble properties. The monoester can replace in whole or in part the shorter chain soaps, such as that derived from coconut oil.

13 Claims, No Drawings

DETERGENT COMPOSITIONS CONTAINING FATTY ACID SOAP AND MONOESTERS OF DICARBOXYLIC ACIDS

This is a continuation application of Ser. No. 914,022, filed Oct. 1, 1986 now abandoned.

FIELD OF THE INVENTION

This invention relates to detergent compositions intended for personal washing containing water soluble salts of long chain ($C_8$ to $C_{22}$) monocarboxylic acids. These products will generally be in solid form and usually in bar form but may alternatively be prepared in, for example, sheet or powder form.

BACKGROUND TO INVENTION

Conventional solid soap compositions intended for personal use usually have a major proportion by weight of salts of longer chain, i.e. $C_{16}$ and above, monocarboxylic acids and a minor proportion by weight of salts of shorter chain, i.e. $C_{14}$ and below, monocarboxylic acids. A typical soap composition intended for personal use will contain between about 55% and 80% of $C_{16}$ and above salts and between about 45% and 20% of $C_{14}$ and below salts. Usually the $C_{16}$ and above salts will form at least about 60% by weight of the soap content and more usually at least about 70% by weight.

The feedstocks which provide the long chain monocarboxylic acids may be obtained from natural sources i.e. fats and oils, or synthetic sources, e.g. oxidation of paraffins. However, the natural sources form by far the larger feedstock proportion. Fats and oils from plants, animal and marine sources are used throughout the world in proportions depending on the local conditions of supply and the economy. The shorter chain length materials are acknowledged as the components providing the lather generated during use and a common source of these components is coconut oil. This oil is in wide demand for soap making and, despite the considerable world production, its price is consistently above those for the other soap making fats and oils, in particular those providing the $C_{16}$ and above chain lengths. These cost considerations are general to any lauric source oil.

Soap makers have in the past given considerable attention to the possibility of replacing some or all of the coconut derived acids by other, more economic, materials while retaining the properties associated with the coconut derived materials. Examples of disclosures already present in the literature are UK Nos. 1281895, 1295275, 1314604 and 1287895 (Unilever).

GENERAL DESCRIPTION OF THE INVENTION

According to the present invention there is provided a detergent composition including salts of monocarboxylic acids containing in the range of 8 to 22 carbon atoms and having a cation providing water soluble properties, and a second anionic material characterised in that the second anionic material comprises water soluble salts of monoesters of general formula:

$$ROOC—(CH_2)_n—COOM$$

wherein R is a linear or a branched alkyl or alkenyl group containing 4 to 12 carbon atoms, n is 2, 3 or 4 and M is a cation providing water soluble properties.

The level of these monoesters in the total detergent composition can be from about 2% to about 20% by weight, preferably from about 4% to about 12%. The cation species M can be alkali metal, alkaline earth metal, or ammonium, the ammonium being optionally substituted with at least one alkyl ($C_1$ to $C_4$) group or at least one alkanol ($C_1$ to $C_4$) group. The commercially used cations will usually be potassium and, preferably, sodium.

Preferably the ester forming group R contains 8 to 10 carbon atoms. Suitably the group R is selected from the group comprising n-octyl, iso-octyl, iso-nonyl, iso-decyl and 2-ethyl hexyl. Preferably the monoester is an alkyl or alkenyl succinate, i.e. n=2.

Examples of the alcohols from which the esters may be derived are thus n-octanol, iso-octanol, iso-nonanol, 2-ethyl-hexanol and iso-decanol. The maximum carbon chain length of the monoester is preferably 14 carbon atoms, more preferably 12 carbon atoms. Thus the n-octyl succinate ester gives a carbon length of 12 while isodecanol provides a length of 11 carbon atoms because of branching.

Preferably the said salts of monocarboxylic acids comprise salts of acids containing 16 to 22 carbon atoms. The natural sources for longer chain ($C_{16}$ to $C_{22}$) monocarboxylic acids used in the composition are e.g. tallow, palm, soya oil, castor oil, rice bran oil and fish oil. These feedstocks may require processing, e.g. hardening and dehydroxylation, to provide suitable longer chain acids. Suitably salts of acids containing 16 to 22 carbon atoms comprise at least 55 wt %, more suitably at least 60 wt %, even more suitably at least 70 wt % of the total salts present of monocarboxylic acids. An upper limit is 100 wt %, preferably 95 wt %.

The said salts of monocarboxylic acids preferably further comprise salts of acids containing 8 to 14 carbon atoms. Such soaps will usually be obtained from high lauric oils such as palm kernel oil, babassu oil and coconut oil. Suitably salts of monocarboxylic acids containing 8 to 14 carbon atoms comprise at most 45%, more suitably at most 40 wt %, even more suitably at most 30 wt %, of the total salts present of monocarboxylic acids. The salts of monocarboxylic acids containing 8 to 14 carbon atoms can however comprise at most 5 wt %, or even 0 wt %, of the total salts of monocarboxylic acids present.

The cation of the salts of monocarboxylic acids can for example be sodium or potassium. Preferably it is sodium.

The applicants have thus found that at least the shorter chain ($C_{14}$ and below) lauric salts can be replaced in whole or in part by the water soluble salts of monoesters of the above formula $ROOC(CH_2)_nCOOM$. In particular it has been found that the lather produced by the detergent compositions of the invention containing the monoester at the same level as for example coconut soaps in conventional soap can be more in quantity and more stable than the lather obtained with conventional soaps containing coconut soaps. The present detergent compositions can thus show synergistic action in lather.

The detergent composition may optionally contain other components known as additives to solid compositions. Examples are pigments, stabilisers, fluorescers, germicides, free fatty acids, perfumes and non-soap detergents. The present compositions may also contain additional non-soap detergents. Examples of such ingredients are alkane sulphonates, alcohol sulphates, alkyl benzene sulphonates, alkyl sulphates, acyl isethionates, olefin sulphonates and ethoxylated alcohols.

The detergent composition of the present invention can be processed into solid form such as bar, sheet or powder form by conventional methods. Bar form is preferred.

Embodiments of the present invention will now be described by way of example only with reference to the following Examples.

Manufacture of materials

Preparation of the monoester is illustrated by the following method for preparing the sodium salt of n-octylhydrogen succinate.

Succinic anhydride (700 g) and n-octanol (910g) were mixed and heated with stirring at a temperature of 120°±5° C. In an hour the mixture homogenised. Progress of reaction was monitored by Acid Value (AV) drop of the reaction mixture. In 2 hours AV was 249 and in about 3 hours it stabilised to a value of 244 (theoretical AV for n-octyl hydrogen succinate is 243.6). At a temperature of about 35° C., n-octyl hydrogen succinate (1 kg) was neutralised with sodium carbonate solution (644 ml of a solution of sodium carbonate containing 230.4 g sodium carbonate) added over a period of 1 hour with slow stirring. The reaction mass was agitated for a further period of 1 hour and left overnight. The mass was poured into a stainless steel tray and kept on a boiling water bath with occasional stirring. After about 6 hours a thick paste was obtained which was finally dried in an oven at 100° C. for an hour. The final product containing sodium n-octyl succinate was produced at a yield of 1.33 kg (theoretical yield=1.096 kg). A sample on acidulation and ether extraction indicated the presence of about 66% n-octyl succinic acid; total volatiles were estimated as 24.2%.

All samples of sodium mono-alkyl succinate employed in the present Examples were prepared using this procedure. If the AV did not drop to the expected theoretical values, reactions were terminated when the value stabilised and remained constant. This happened in cases where commercial alcohols were assumed to be of 100% purity. The products were characterised using H-NMR, AV and TLC.

The succinate esters can alternatively be prepared using maleic anhydride as an initial reactant with subsequent reduction.

Lather test methodology

The important contribution of coconut oil fatty acids in soap composition is to increase its lather. Lather assessment in use is however a subjective parameter and different quantitative methods have been devised for its measurements. The method used in the experiments described in the examples below is as follows:

Lather from a composition was generated using a domestic kitchen mixer. Soap chips (10 g) were placed in the mixer with water (100 ml) of 24° French hardness. The mixer was run for 20 seconds, stopped for 20 seconds and then run for 20 seconds. The lather was then poured into a measuring cylinder and the volume was recorded after 5 minutes to obtain an estimate of the durable lather.

EXAMPLES 1-14

Detergent compositions were prepared in the laboratory by mixing sodium mono alkyl hydrogen succinates in a soap base deficient in coconut soap. Two soap bases A and B have been used in which shorter chain fatty acids of $C_{14}$ and below were less than 4% by weight and less than 2% by weight respectively. The sodium mono alkyl hydrogen succinates were incorporated at two levels: 5% by weight and 10% by weight.

Control samples were prepared by mixing coconut soap in the soap base in the same manner as the experimental compounds.

The compositions prepared forming Examples 1 to 14 are given in Table 1. The fatty acid composition of soap bases used is given in Table 2.

The lather volumes for the compositions of Examples 1-14 are given in Table 3, side by side with the lather values for the components: soap base and sodium salt of mono alkyl hydrogen succinates respectively in water at the levels corresponding to those used in each example.

TABLE 1

| | COMPOSITIONS (% by wt) | | |
|---|---|---|---|
| EXAMPLE No. | SOAP BASE | SODIUM SALT OF | |
| 1 | A-95 | n-octyl hydrogen succincate | 5 |
| 2 | A-90 | " | 10 |
| 3 | A-95 | 2-ethyl hexyl hydrogen succinate | 5 |
| 4 | A-90 | " | 10 |
| 5 | A-95 | Iso-octyl hydrogen succinate* | 5 |
| 6 | A-90 | " | 10 |
| 7 | A-95 | Iso-nonyl hydrogen succinate** | 5 |
| 8 | A-90 | " | 10 |
| 9 | A-95 | Cocount oil fatty acids | 5 |
| 10 | A-90 | " | 10 |
| 11 | B-95 | Isononyl hydrogen succinate** | 5 |
| 12 | B-90 | " | 10 |
| 13 | B-95 | Coconut oil fatty acids | 5 |
| 14 | B-90 | " | 10 |

*Prepared from commercial isooctanol (dimethyl hexanol 80% and methyl heptanol - 20%).

**Prepared from commercial isononanol (trimethyl hexanol 95% and mixed alkylol - 5%).

TABLE 2

| FATTY ACID COMPOSITION OF SOAP BASE | | |
|---|---|---|
| Fatty acid | SOAP BASE A (mixed Soapery oil feedstock) (% by wt) | SOAP BASE B (ex. hardened rice bran oil fatty acid) (% by wt) |
| $C_8$ | 0.8 | t |
| $C_{10}$ | 0.2 | t |
| $C_{12}$ | 2.0 | 0.6 |
| $C_{14}$ | 0.7 | 0.9 |
| $C_{16}$ | 19.7 | 21.5 |
| $C_{18}$ | 30.3 | 2.8 |
| $C_{18:1}$ | 37.4 | 45.0 |
| $C_{18:2}$ | 7.3 | 28.3 |
| $C_{20}$ | 1.3 | 0.9 |

t = traces

TABLE 3

| LATHER VOLUMES OBSERVED | | | | | |
|---|---|---|---|---|---|
| | | LATHER VOLUME OF COMPONENTS | | | |
| | | Soap base | | Sodium salt of mono alkyl hydrogen succinate or coconut fatty acids (c) | |
| EXAMPLE No. | LATHER VOLUME (ml) OF COMPOSITIONS 10 g of composition of the example dissolved in 100 ml water | g/100 ml water | Lather Vol. (ml) | g/100 ml water | Lather Vol. (ml) |
| 1 | 260 | 9.5 | 145 | 0.5 | 7 |
| 2 | 335 | 9.0 | 145 | 1.0 | 130 |
| 3 | 260 | 9.5 | 145 | 0.5 | 0 |
| 4 | 327 | 9.0 | 145 | 1.0 | 0 |
| 5 | 250 | 9.5 | 145 | 0.5 | 0 |

TABLE 3-continued

| LATHER VOLUMES OBSERVED | | | | | |
|---|---|---|---|---|---|
| | | LATHER VOLUME OF COMPONENTS | | | |
| | | Soap base | | Sodium salt of mono alkyl hydrogen succinate or coconut fatty acids (c) | |
| EXAMPLE No. | LATHER VOLUME (ml) OF COMPOSITIONS 10 g of composition of the example dissolved in 100 ml water | g/100 ml water | Lather Vol. (ml) | g/100 ml water | Lather Vol. (ml) |
| 6 | 320 | 9.0 | 145 | 1.0 | 15 |
| 7 | 300 | 9.5 | 145 | 0.5 | 0 |
| 8 | 405 | 9.0 | 145 | 1.0 | 40 |
| 9 | 210 | 9.5 | 145 | 0.5 | 236 (c) |
| 10 | 270 | 9.0 | 145 | 1.0 | 384 (c) |
| 11 | 285 | 9.5 | 183 | 0.5 | 0 |
| 12 | 348 | 9.0 | 183 | 1.0 | 40 |
| 13 | 236 | 9.5 | 183 | 0.5 | 236 (c) |
| 14 | 292 | 9.0 | 183 | 1.0 | 384 (c) |

It can be seen from Table 3 that in the case of sodium salt of alkyl hydrogen succinates, the detergent composition have higher lather values than the separate components. Further, the experimental compositions 108 and 11-12 produce more lather than the corresponding control samples with only coconut soaps (examples 9, 10 and 13, 14).

EXAMPLE 15

The composition of Example 7 (i.e. with 5% sodium salt of isononyl hydrogen succinate) was made on large scale and soap bars prepared were assesed for actual user performance, in comparison with control soap with 10% coconut fatty acid composition as in Example 10.

The in-use performance for both the samples was not statistically different. Thus showing that 5% of sodium salt of isononyl hydrogen succinate can replace 10% of coconut oil soap in personal washing soaps.

These results show that the mono-ester succinates can generally provide more lather than coconut derived soap, weight for weight or at even lower ratios. Further, the detergent compositions embodying the present invention were similar to control in other respects and in use.

I claim:

1. A detergent composition comprising from about 80% to about 98% by weight with respect to the total composition of salts of monocarboxylic acids containing in the range of 8 to 22 carbon atoms and having a cation providing water soluble properties, and from about 2% to about 20% by weight with respect to the total composition of a second anionic material comprising water soluble salts of monoesters of the general formula:

$$ROOC—(CH_2)_n—COOM$$

wherein R is a linear or a branched alkl or alkenyl group containing 4 to 10 carbon atoms, n is 2, 3 or 4, and M is a cation providing water soluble properties.

2. A detergent composition according to claim 1 wherein the cation M is alkali metal, alkaline earth metal or ammonium, the ammonium optionally substituted with at least one alkyl or alkanol group containing 1 to 4 carbon atoms.

3. A detergent composition according to claim 1 wherein the group R contains 8 to 10 carbon atoms.

4. A detergent composition according to claim 1 wherein the group R is selected from the group comprising n-octyl, iso-octyl, iso-nonyl, iso-decanol and 2-ethyl hexyl.

5. A detergent composition according to claim 1 wherein the monoester is an alkyl or alkenyl succinate.

6. A detergent composition according to claim 1 wherein the composition contains from about 4 to about 12 wt % of the said monoester.

7. A detergent composition according to claim 1 wherein the said salts of monocarboxylic acids comprise salts of acids containing 16 to 22 carbon atoms.

8. A detergent composition according to claim 7 wherein the salts of acids containing 16 to 22 carbon atoms comprise at least 60 wt % of the total salts present of monocarboxylic acids.

9. A detergent composition according to claim 7 wherein the said salts of monocarboxylic acids further comprise salts of acids containing 8 to 14 carbon atoms.

10. A detergent composition according to claim 9 wherein the salts of acids containing 8 to 14 carbon atoms comprise at most 40 wt % of the total salts present of monocarboxylic acids.

11. A detergent composition according to claim 10 wherein the said salts comprise at most 30 wt % of the said total salts.

12. A detergent composition according to claim 11 wherein the said salts comprise at most 5 wt % of the said total salts.

13. A detergent composition according to claim 1 in bar, sheet or powder form.

* * * * *